US006273561B1

(12) United States Patent
Ahn

(10) Patent No.: US 6,273,561 B1
(45) **Date of Patent: *Aug. 14, 2001**

(54) ELECTROPHOTOGRAPHIC APPARATUS CARTRIDGE FOR HIGH SPEED PRINTING

(75) Inventor: Byung-Sun Ahn, Kyungki-do (KR)

(73) Assignee: SamSung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/196,764

(22) Filed: Nov. 20, 1998

(30) Foreign Application Priority Data

Nov. 20, 1997 (KR) ..... 97-61355

(51) Int. Cl.[7] ..... B41J 2/75
(52) U.S. Cl. ..... 347/86
(58) Field of Search ..... 347/84, 85, 86, 347/87, 40, 42, 107

(56) References Cited

U.S. PATENT DOCUMENTS

| | | | | |
|---|---|---|---|---|
| 4,539,569 | * | 9/1985 | Watanabe et al. | 347/43 |
| 4,771,295 | * | 9/1988 | Baker et al. | 347/87 |
| 4,812,859 | * | 3/1989 | Chan et al. | 347/63 |
| 5,581,283 | * | 12/1996 | Rogers | 347/40 |

* cited by examiner

*Primary Examiner*—N. Le
*Assistant Examiner*—Michael Nghiem
(74) *Attorney, Agent, or Firm*—Robert E. Bushnell, Esq.

(57) ABSTRACT

An electrophotographic apparatus cartridge that has multiple print heads. The use of multiple heads result in the effective printing height of the cartridge being increased. By increasing the effective printing height of the cartridge the amount of area on a sheet of paper that is printed upon with each pass of the cartridge is increased. This results in an increase in the speed of printing. By using multiple printer heads the amount of adjustments that must be made to existing manufacturing lines is reduced. In addition, by precisely placing the multiple print heads relative to each other greater print quality can be obtained from the electrophotographic apparatus.

23 Claims, 4 Drawing Sheets

ELECTROPHOTOGRAPHIC APPARATUS CARTRIDGE FOR HIGH SPEED PRINTING

CLAIM OF PRIORITY

This application makes reference to, incorporates the same herein, and claims all benefits accruing under 35 U.S.C. §119 from my application entitled High Speed Printing Device of InkJet Print Head filed with the Korean Industrial Property Office on Nov. 20, 1997 duly assigned Ser. No. 97-61355 by that Office.

BACKGROUND OF THE INVENTION

1. Field of the Invention

The present invention relates to an electrophotographic apparatus cartridge for high speed printing and, more specifically, to a cartridge that increases the print speed in an electrophotographic apparatus by increasing the effective printing height of the cartridge.

2. Background Art

With the greater amounts of information being generated by computers, the development of printer technology has become increasingly important. One popular type of printer is the ink-jet printer. There are two types of ink-jet printers, the continuous jet type and the drop on demand type of ink jet printer. The continuous ink-jet printers project a continuous spray of ink drops from a small nozzle toward a recording medium. In contrast, the drop on demand ink-jet printers release droplets in response to signals from a controller. The controller causes changes in the pressure within the ink storage chamber of the printer cartridge resulting in a succession of droplets being ejected. Many advancements have been made in ink-jet technology due to continuing efforts to increase printer speed and to improve the resolution of printed images. There are many methods for increasing the print speed of an electrophotographic apparatus.

Generally, an ink-jet cartridge prints by jetting ink onto a medium of cut paper while moving in a rectilinear reciprocating fashion. I have observed that by increasing the printing height of a print head the speed of a printer can be increased. This, however, results in the resolution of the electrophotographic apparatus being decreased. In addition, the production of print heads having a greater printing height increases the probability of errors made in the nozzle spacing during manufacturing. Currently, many print heads are manufactured using a lithography process. This process can result in errors that cause improper intervals to be formed between nozzles on the cartridge. For example, an ink-jet print head cartridge that has a printing height of 1 inch and a resolution of 600 dots per inch, hereinafter referred to as "dpi", may be manufactured with 600 ink jetting chambers, or nozzles, that are formed on one print head. If one of the nozzles is deformed, then the entire print head must be discarded. This results in a waste of materials and in the re treading of manufacturing production lines to produce cartridges that have a higher number of nozzles when a producer desires to produce a cartridge with an increased number of nozzles.

As such, I believe that it may be possible to improve on the contemporary art by providing a cartridge for an electrophotographic apparatus that does not require the re-treading of production lines to accommodate an increase in the number of nozzles desired on a cartridge, that does not increase the complexity required to produce print heads, that increases the printing height of the cartridge, that increases the printing speed of an electrophotographic apparatus, and that does not require significant changes to existing manufacturing methods to produce.

SUMMARY OF THE INVENTION

Accordingly, it is an object of the present invention to provide an improved electrophotographic apparatus ink cartridge.

It is another object to provide an electrophotographic apparatus ink cartridge that does not require the re-treading of production lines to accommodate an increase in the number of nozzles attached to a cartridge.

It is still another object to provide an electrophotographic apparatus ink cartridge that does not increase the complexity required to produce print heads.

It is yet another object to provide an electrophotographic apparatus ink cartridge that increases the printing height of the cartridge.

It is still yet another object to provide an electrophotographic apparatus ink cartridge that increases the printing speed of an electrophotographic apparatus.

It is a further object to provide an electrophotographic apparatus ink cartridge that does not require significant changes to existing manufacturing methods to produce.

To achieve these and other objects, a cartridge is provided that may be constructed using an ink storage box, or reservoir, for storing ink. Attached to the cartridge are multiple print heads that result in the effective printing height of the cartridge being increased. By increasing the effective printing height of the cartridge the amount of area on a sheet of paper that is printed upon with each pass of the cartridge is increased. This results in an increase in the speed of printing. By using multiple printer heads the amount of adjustments that must be made to existing manufacturing lines is reduced. In addition, by precisely placing the multiple print heads relative to each other greater print quality can be obtained from the electrophotographic apparatus.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF THE DRAWINGS

Figure 1A:
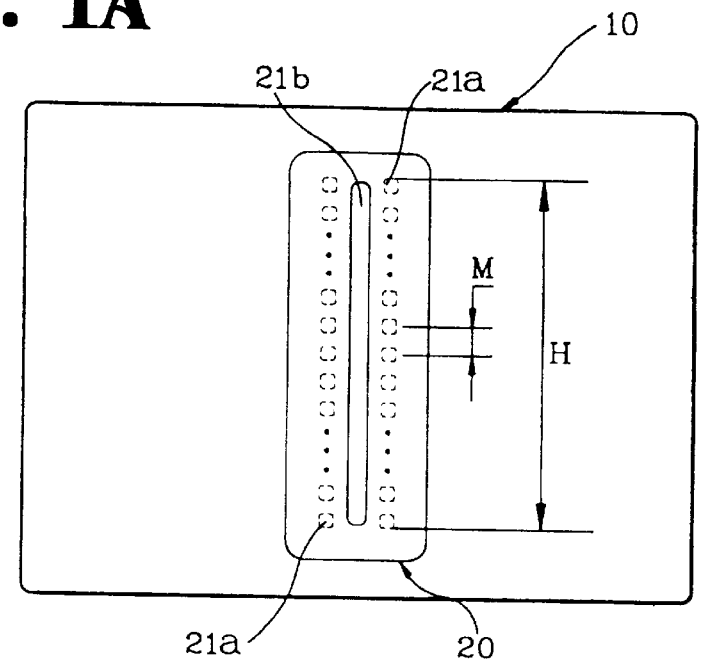
FIG. 1A is a bottom view of an electrophotographic ink cartridge.
Figure 1B:
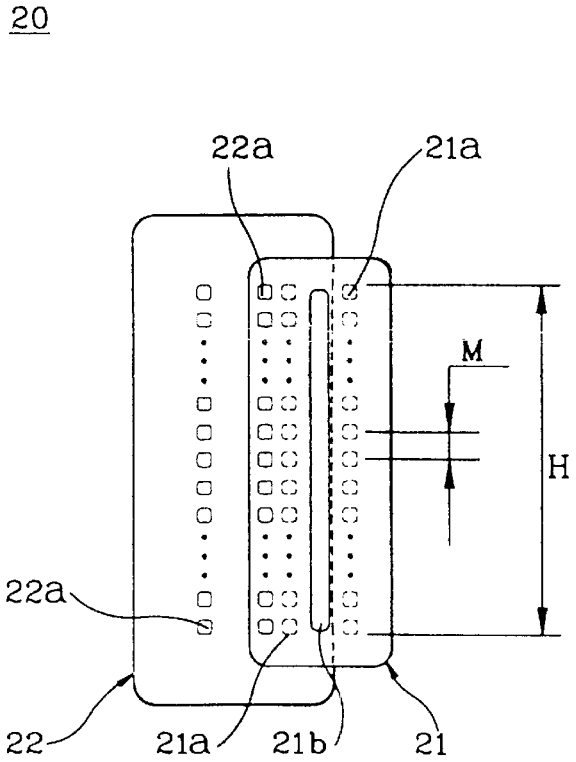
FIG. 1B is plan view of the print head of FIG. 1A.

Turning now to the drawings, FIG. 1A and FIG. 1B illustrate an electrophotographic apparatus ink cartridge that may be constructed using a body that contains ink storage box, or reservoir, 10 for storing ink and ink jetting device, or print head, 20 for jetting ink that is supplied from ink storage box 10. Ink jetting device 20 has 150 ink jetting chambers, or nozzles, 21*a*. Nozzle plate 22 has nozzles 22*a* attached so as to align 300 ink jetting chambers 21*a* that are formed on ink jetting chip 21.

Figure 2:
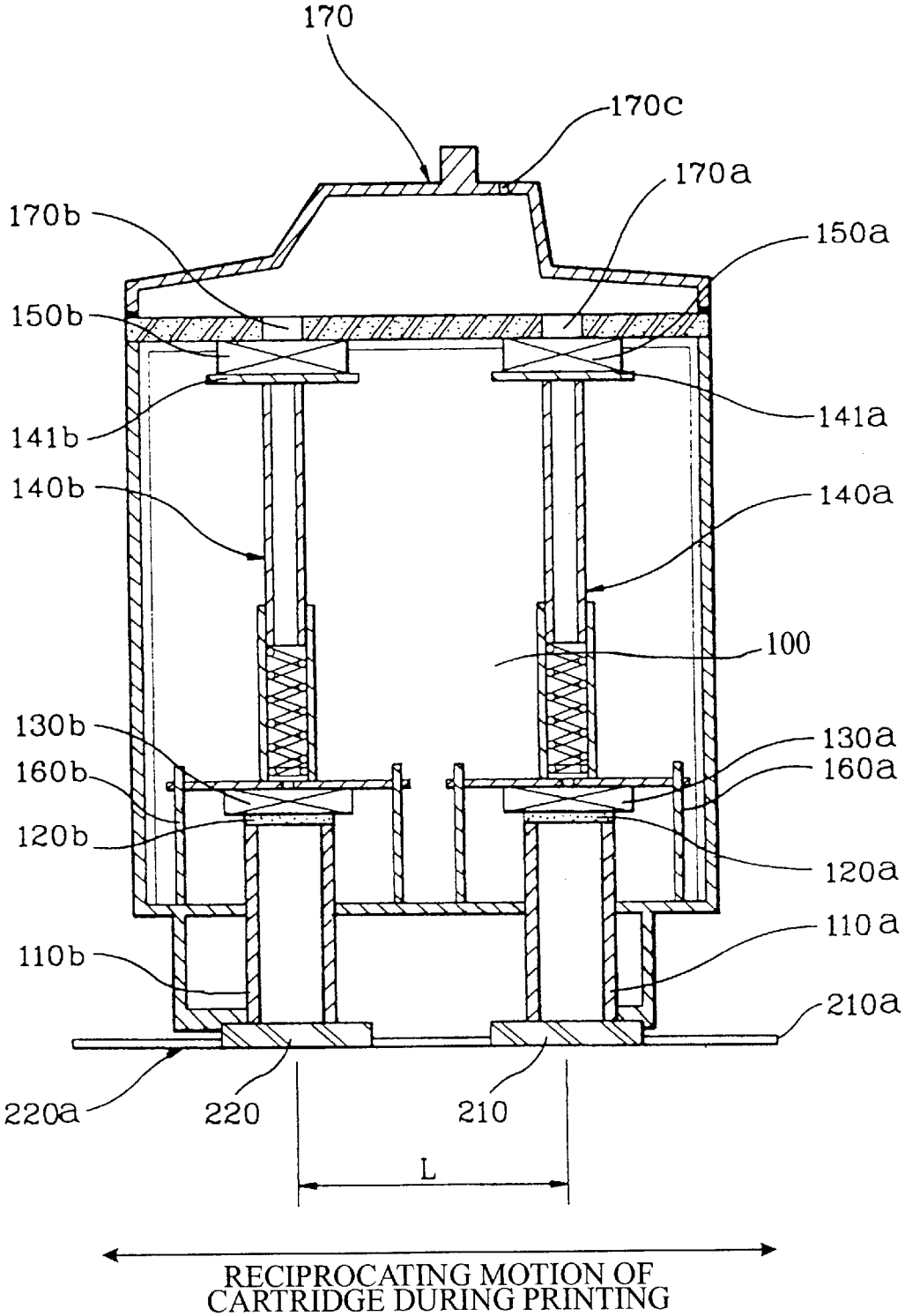
FIG. 2 is a side view of an electrophotographic cartridge as constructed according to the principles of the present invention.
Figure 3:
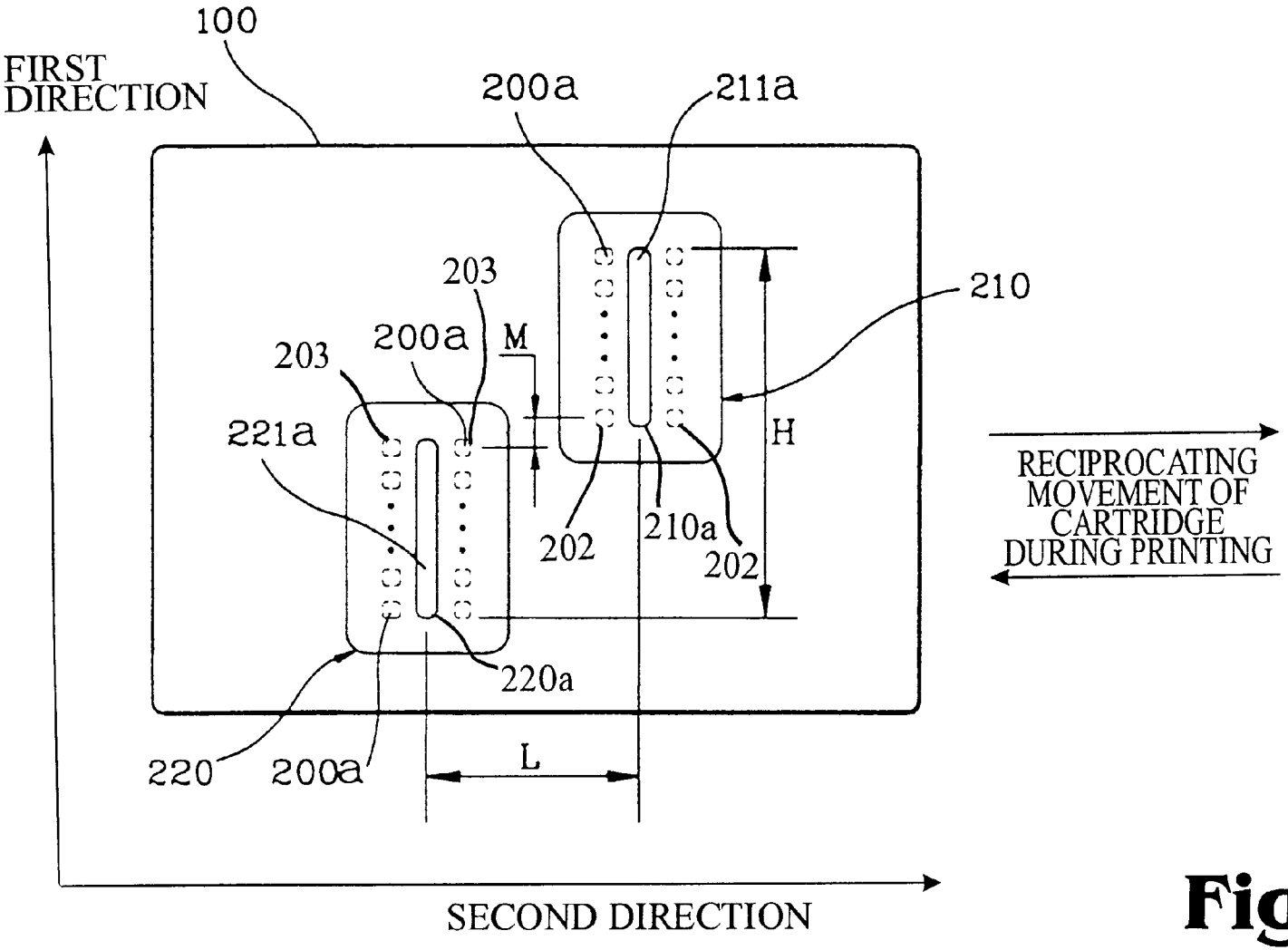
FIG. 3 is a bottom view of the cartridge of FIG. 2.

FIG. 2 and FIG. 3 illustrate an electrophotographic apparatus ink cartridge as formed according to the principles of the present invention. The cartridge may be formed using an ink storage box, or reservoir, for storing ink. Attached to the bottom side, or first surface, of the cartridge are ink jetting devices, or printer heads, 210 and 220 that propel ink towards a cut sheet of paper. An interval, or a first predetermined distance, as denoted by 'M', is maintained to ensure quality while achieving a certain printing height, as denoted by 'H'. The print heads are separated by a length, or second predetermined distance, as denoted by 'L'.

The electrophotographic apparatus ink cartridge may be constructed using an ink storage box, or reservoir, 100 for storing ink. First ink supply pipe 110*a* and second ink supply pipe 110*b* both of which create ink supply channels for the printer heads and are integrated into the body of the cartridge. The printer heads are located on a bottom side, or first surface, of the cartridge. Ink is propelled by the printer heads towards a cut sheet of printable medium to form images that correspond to electrical signals that are received by the printer heads. First filter 120*a* and second filter 120*b* are attached, possibly using an adhesive, to an upper side of first ink supply pipe 110*a* and second ink supply pipe 110*b*. This causes the ink to be filtered prior to entering the supply pipes and being ejected via the print heads.

First ink supply pipe 110*a* and second ink supply pipe 110*b* are formed in ink storage box 100 in an integrated system. Furthermore, first filter 120*a* and second filter 120*b* filter ink and are sealed and adhered to the ink supply pipes 110*a* and 110*b*. First ink jetting device 210 and second ink jetting device 220 may be constructed with the inside diameter being small so that the ink supply pressure goes up. For this reason, ink can be supplied with high speed into the first inkjetting device 210 and the second ink jetting device 220. Ink stored in ink storage box 100 is filtered by first filter 120*a* and second filter 120*b* and then supplied into first ink supply and second ink supply through first ink supply pipe 110*a* and second ink supply pipe 110*b* forming a plural number of supply channels. The first ink supply pipe 110*a* and second ink supply pipe 110*b* supply the ink into a number of ink jetting chambers, or nozzles, 200*a* that are formed in the first ink jetting device, or first printer head, 210 and second ink jetting device, or second printer head, 220, respectively.

As illustrated in FIG. 2, inhalers 130*a* and 130*b* draw ink into the first filter and the second filter, respectively. First pressure supporter 140*a* and second pressure supporter 140*b* are constructed to give a certain pressure to inhalers 130*a* and 130*b*. Supporters 160*a* and 160*b* are constructed to support first pressure supporter 140*a* and second pressure supporter 140*b*, respectively.

In addition, a number of sponge supporters 141*a* and 141*b* are formed on the upper side of first pressure supporter 140*a* and second pressure supporter 140*b* to support first sponge 150*a* and second sponge 150*b* to prevent stored ink from flowing out of the cartridge through air vents 170*a* and 170*b*. Fine holes are formed in first sponge 150*a* and second sponge 150*b* so that air can flow through air vent 170*c* that is formed in cap 170 of the ink storage box 100. Ink inhaled by inhalers 130*a* and 130*b* is supplied to first filter 120*a* and second filter 120*b* by pressure generated by first pressure supporter 140*a* and second pressure supporter 140*b*. The first filter 120*a* and the second filter 120*b* are supplied with ink that is transported to first ink jetting device 210 and second ink jetting device 220 through first ink supply pipe 110*a* and second ink supply pipe 110*b* that form ink supply channels in the cartridge after the filters have eliminated foreign substances from the ink.

First ink jetting device 210 and second ink jetting device 220 are supplied with ink through first ink supply pipe 110*a* and second ink supply pipe 110*b* and eject the ink to form print by jetting ink in response to electric energy that is supplied to first electrode terminal 210*a* and second electrode terminal 220*a*. After electric energy is supplied to first ink jetting device 210 through first electrode terminal 210*a* there is a time delay that depends on the second predetermined distance.

First inkjetting device 210 and second inkjetting device 220 are mounted with an orientation that maintains a predetermined interval between nozzles. In specific, it is desired to maintain a first predetermined distance, as denoted by 'M', along a first direction, as shown in FIG. 3. It is also desired to maintain a second predetermined distance between the center of the print heads, as denoted by 'L' in FIG. 3. The spacing between the printer heads is designed so that nozzles an array of 202 on printer head 210 is separated from nozzles 203 on printer head 220 by a first predetermined interval, denoted by 'M', along the first direction. An axis is drawn next to the bottom of the cartridge in FIG. 3 to identify the first direction and second direction as used in both the specification and the claims. As further shown by arrows in FIG. 3, the cartridge moves in a rectilinear reciprocating fashion along the second direction.

Figure 4A:
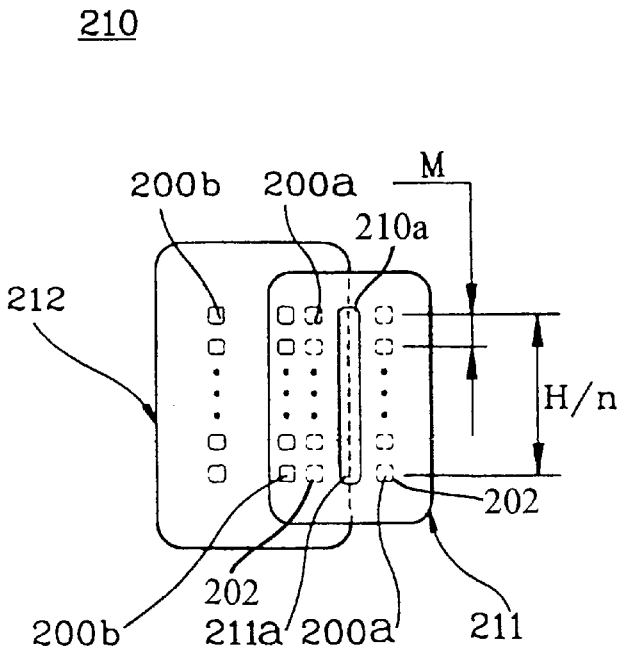
FIG. 4*a* is a plan view of a print head of the cartridge of FIG. 2.
Figure 4B:
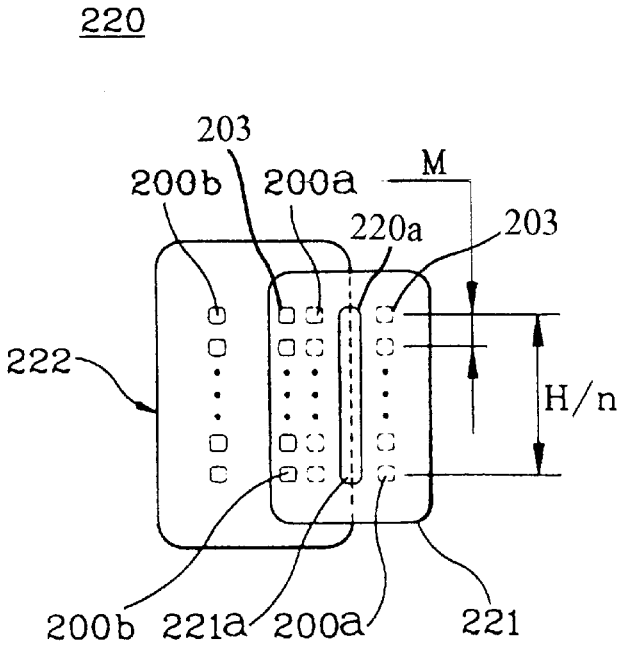
FIG. 4*b* is a plan view of a second print head of the cartridge of FIG. 2.

As illustrated in FIG. 4A and FIG. 4B, first ink jetting device, or first printer head, 210 may be constructed using first ink jetting chip 211 for supplying and jetting ink. First nozzle part 212 for forming nozzle 200*b* through which ink is being expelled from first ink jetting chip 211. Second ink jetting device 220 may be constructed using second ink jetting chip 221 for jetting ink from second nozzle part 222. Nozzle 200*b* allows ink to be expelled through second ink jetting chip 221. First ink jetting chip 211 may be constructed with first ink supply 211*a* that supplies ink from said ink storage box, or reservoir. Second ink jetting chip 221 may be constructed with second ink supply 221*a* that supplies ink from said ink storage box.

As also illustrated in FIG. 4*a* and FIG. 4*b*, each one of first ink jetting device, or first printer head, 210 and second ink jetting device, or second printer head, 220, after being produced has an ink jetting chip 211 and 221, respectively, attached. The ink jetting chips 211 and 221 are manufactured through a lithography production process and respectively bear a first nozzle part 212 and a second nozzle part 222. Each one of first ink jetting chip 211 and second ink jetting chip 221 is formed using the same pattern and can be produced on a wafer at the same time. The reference 'H/n' that is denoted in FIG. 4A refers to the printing height, as denoted by 'H', and the number of nozzles, as denoted by 'n'.

Each inkjetting chamber, or nozzle, 200*a* formed on first inkjetting chip 211 and second ink jetting chip 221 is formed by the same pattern. The ink jetting device is constructed on a wafer by dividing the chip into a first ink jetting chip 211 and a second ink jetting chip 221.

First ink jetting chip 211 and second ink jetting chip 221 may be separately produced on a wafer. In addition, the inkjetting chip may be produced by dividing into two pieces to construct the first ink jetting chip 211 and the second ink jetting chip 221. This allows the errors that are formed by a mistake in the nozzle patterns to be reduced.

When first ink jetting chip 211 and second ink jetting chip 221 are produced, first nozzle part 212 and second nozzle part 222 are assembled into the first ink jetting chip 211 and the second ink jetting chip 221 respectively. Here, a number of nozzles 200*b* are formed in the first nozzle part 212 and the second nozzle part 222 in accordance with a number of ink jetting chambers 200*a* that are formed in the first ink jetting chip 211 and the second ink jetting chip 221.

When a number of nozzles 200*b* are formed in first nozzle part 212 and second nozzle part 222 respectively, nozzles 200*b* are aligned and assembled into a number of ink jetting chambers, or nozzles, 200*a* that are formed in first ink jetting chip 211 and second ink jetting chip 221, respectively. As the ink jetting device is constructed by dividing first ink jetting device 210 and second inkjetting device 220, the production can be more conveniently performed while the printing height of the cartridge is increased.

When the first ink jetting device 210 and the second ink jetting device 220 are constructed by assembling first nozzle part 212 and second nozzle part 222 into first ink jetting chip 211 and second ink jetting chip 221, they are then mounted on the body that encloses reservoir 100. Here, first ink jetting device 210 and second ink jetting device 220, as illustrated in FIG. 3, are mounted to maintain a nozzle interval, as denoted by 'M', for holding a certain printing height, as denoted by 'H', as measured along a first direction and for maintaining a second predetermined distance, as denoted by 'L', as measured along a second direction.

First ink jetting device 210 and second inkjetting device 220 are mounted to maintain a first predetermined distance, as denoted by 'M', to generate a certain effective printing height, as denoted by 'H', as measured along a first direction.

As explained above, the use of multiple heads result in the effective printing height of the cartridge being increased. By increasing the effective printing height of the cartridge the amount of area on a sheet of paper that is printed upon with each pass of the cartridge is increased. This results in an increase in the speed of printing. By using multiple printer heads the amount of adjustments that must be made to existing manufacturing lines is reduced. In addition, by precisely placing the multiple print heads relative to each other greater print quality can be obtained from the electrophotographic apparatus.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A cartridge for a printer apparatus, said cartridge comprising:

a body having a first surface through which ink is discharged, the ink being discharged from said body to a recordable medium during a printing operation, said body being transported back and forth along a first line of horizontal motion during the printing operation, the recordable medium being transported along a second line of vertical motion during the printing operation;

a reservoir being attached to said body and containing the ink;

a first print head being attached to said first surface and comprising a first plurality of nozzles forming at least one row substantially perpendicular to said first line of horizontal motion, said at least one row of said first plurality of nozzles including a first nozzle in a lowest vertical position and a last nozzle in a highest vertical position, all adjacent nozzles in said at least one row of said first plurality of nozzles being separated from each other by an equal distance, said first print head having a first printing height, said first printing height being measured from said first nozzle in said at least one row of said first plurality of nozzles up to said last nozzle in said at least one row of said first plurality of nozzles;

a second print head being attached to said first surface and comprising a second plurality of nozzles forming at least one row substantially perpendicular to said first line of horizontal motion, said at least one row of said second plurality of nozzles including a first nozzle in a lowest vertical position and a last nozzle in a highest vertical position, all adjacent nozzles in said at least one row of said second plurality of nozzles being separated from each other by said equal distance, said second print head having a second printing height, said second printing height being measured from said first nozzle in said at least one row of said second plurality of nozzles up to said last nozzle in said at least one row of said second plurality of nozzles;

a first supply pipe with a first filter, said first supply pipe supplying the ink from said reservoir through the first filter to said first print head; and a second supply pipe with a second filter, said second supply pipe supplying the ink from said reservoir through the second filter to said second print head, said first and second supply pipes being separately located;

said first print head and said second print head being positioned with said at least one row of said first plurality of nozzles being substantially parallel to said at least one row of said second plurality of nozzles, said cartridge having a total printing height substantially equal to the sum of said first printing height and said second printing height, said first nozzle of said at least one row of said first plurality of nozzles being adjacent to said last nozzle of said at least one row of said second plurality of nozzles, said first nozzle of said at least one row of said first plurality of nozzles being separated from said last nozzle of said at least one row of said second plurality of nozzles by said equal distance as measured perpendicular to said first line of horizontal motion.

2. The cartridge of claim 1, further comprising:

a first vent venting gas for said first print head; and a second vent venting gas for said second print head, said first and second vents being separately located, said apparatus being for monochrome printing and not being for color printing.

3. The cartridge of claim 2, further comprising:

a first sponge being positioned adjacent to said first vent, said first sponge preventing the ink from flowing out of said cartridge through said first vent; and a first sponge supporter supporting said first sponge.

4. The cartridge of claim 2, further comprising:

a first sponge being positioned adjacent to said first vent, said first sponge preventing the ink from flowing out of said cartridge through said first vent;

a first sponge supporter supporting said first sponge;

a second sponge being positioned adjacent to said second vent, said second sponge preventing the ink from flowing out of said cartridge through said second vent; and a second sponge supporter supporting said second sponge.

5. The cartridge of claim 1, further comprising:

a first vent venting gas for said first print head; and a first sponge being positioned adjacent to said first vent, said first sponge preventing the ink from flowing out of said cartridge through said first vent.

6. The cartridge of claim 5, further comprising: a first inhaler being attached to said first filter, the ink being conveyed through said first inhaler then transported through said first filter and said first supply pipe, and then the ink being ejected via said first print head.

7. The cartridge of claim 6, further comprising:

a second vent venting gas for said second print head;

a second sponge being positioned adjacent to said second vent, said second sponge preventing the ink from flowing out of said cartridge through said second vent; and a second inhaler being attached to said second filter, the ink being conveyed through said second inhaler then transported through said second filter and said second supply pipe, and then the ink being ejected via said second print head.

8. An apparatus, comprising:

a cartridge having a first surface through which ink is discharged during a printing operation, the ink being discharged from said cartridge to a recordable medium, said cartridge being transported back and forth along a first line of motion;

a reservoir being attached to said cartridge and containing the ink;

a first print head being attached to said first surface and comprising a first plurality of nozzles forming at least two rows substantially perpendicular to said first line of motion, said at least two rows including at least a first row parallel to a second row, said first row of nozzles including a first bottom nozzle and a first top nozzle, all adjacent nozzles in said first row of said first plurality of nozzles being separated from each other by an equal distance, said first print head having a first printing height, said first printing height corresponding to a distance from said first bottom nozzle up to said first top nozzle measured in a direction substantially perpendicular to said first line of motion, said equal distance being measured in the direction substantially perpendicular to said first line of motion;

a second print head being attached to said first surface and comprising a second plurality of nozzles forming at least one row, all adjacent nozzles in said at least one row of said second plurality of nozzles being separated from each other by said equal distance, said second print head having a second printing height, said at least one row of nozzles including a second bottom nozzle and a second top nozzle, said second printing height corresponding to a distance from said second bottom nozzle up to said second top nozzle measured in the direction substantially perpendicular to said first line of motion;

a first supply pipe supplying the ink from said reservoir to said first print head; and a second supply pipe supplying the ink from said reservoir to said second print head, said first and second supply pipes being separately located;

said first print head and said second print head being positioned with said at least two rows of said first plurality of nozzles being parallel to said at least one row of said second plurality of nozzles, said cartridge having a total printing height corresponding to a height from said second bottom nozzle up to said first top nozzle as measured in the direction perpendicular to said first line of motion with said first and second print heads being attached to said first surface, said total printing height being substantially equal to the sum of both said first printing height and said second printing height, said first bottom nozzle being separated from said second top nozzle by said equal distance as measured in the direction perpendicular to said first line of motion, said apparatus being for monochrome printing.

9. The apparatus of claim 8, said second plurality of nozzles further comprising a second row parallel to said at least one row of said second plurality of nozzles, every nozzle in said second row being separated from a corresponding nozzle in said first row by an equal distance measured in a direction parallel to said first line of motion.

10. The apparatus of claim 9, further comprising said first print head and said second print head positioned so that a predetermined distance separates a center of said first print head and a center of said second print head, as measured in the direction parallel to said first line of motion.

11. The apparatus of claim 10, further comprising:

a first vent exchanging gas between an interior of said reservoir and an exterior of said reservoir, said first vent exchanging the gas for operation of said first print head; and a second vent exchanging gas between an interior of said reservoir and an exterior of said reservoir, said second vent exchanging the gas for operation of said second print head and not for operation of said first print head, said first and second vents being separately located.

12. The apparatus of claim 11, further comprising:

a first filter being adjacent to said first supply pipe and filtering contaminants from the ink before the ink is ejected from said nozzles of said first print head; and a first inhaler being adjacent to said first filter, the ink being conveyed through said first inhaler, then being transported through said first filter and said first supply pipe, and being ejected via said first print head.

13. The apparatus of claim 12, further comprising:

a second filter being adjacent to said second supply pipe and filtering contaminants from the ink before the ink is ejected from said nozzles of said second print head; and a second inhaler being adjacent to said second filter, the ink being conveyed through said second inhaler, then being transported through said second filter and said second supply pipe, and being ejected via said second print head.

14. A cartridge for an electrophotographic apparatus, comprising:

a body having a first surface through which an ink is discharged, the ink being discharged from said body to a recordable medium during a printing operation, said body being transported back and forth along a first line of motion during the printing operation;

a reservoir being attached to said body and containing the ink;

a first print head being attached to said first surface and comprising a first plurality of nozzles forming at least one row arranged to be substantially perpendicular to said first line of motion, said at least one row of said first plurality of nozzles forming a substantially straight line, said at least one row of said first plurality of nozzles including a first bottom nozzle in an lowest position of said first print head and a first top nozzle in a highest position of said first print head, all adjacent nozzles in said at least one row of said first plurality of nozzles being separated from each other by an equal distance, said first print head having a first printing height, said first printing height being measured from said first bottom nozzle directly to said first top nozzle;

a second print head being attached to said first surface and comprising a second plurality of nozzles forming at least one row arranged to be substantially perpendicular to said first line of motion, said at least one row of said second plurality of nozzles forming a substantially straight line, said at least one row of said second plurality of nozzles including a second bottom nozzle in a lowest position of said second print head and a second top nozzle in a highest position of said second print head, all adjacent nozzles in said at least one row of said second plurality of nozzles being separated from each other by said equal distance, said second print head having a second printing height, said second printing height being measured from said second bottom nozzle directly to said second top nozzle;

a first supply pipe supplying the ink from said reservoir to said first print head; and a second supply pipe supplying the ink from said reservoir to said second print head, said first and second supply pipes being separately located;

said first print head and said second print head being positioned with said at least one row of said first plurality of nozzles being substantially parallel to said at least one row of said second plurality of nozzles, said cartridge having a total printing height corresponding to a height from said second bottom nozzle up to said first top nozzle as measured in a direction perpendicular to said first line of motion with said first and second print heads being attached to said first surface, said total printing height being substantially equal to the sum of both said first printing height and said second printing height, said first bottom nozzle being separated from said second top nozzle by said equal distance as measured in the direction perpendicular to said first line of motion.

15. The cartridge of claim 14, said first print head and said second print head being separated by a predetermined distance between a center of said first print head and a center of said second print head as measured in a direction substantially parallel to said first line of motion.

16. The cartridge of claim 15, further comprised of said first plurality of nozzles being formed in a first plurality of rows and said second plurality of nozzles being formed in a second plurality of rows.

17. The cartridge of claim 16, further comprising:

a filter attached to said first supply pipe opposite from said first print head;

inhaler attached to said filter; and said ink being conveyed through said inhaler, then said ink being transported through said filter and said first supply pipe, and being ejected via said first print head.

18. The cartridge of claim 17, further comprising:

a second filter attached to said second supply pipe opposite from said second print head;

a second inhaler attached to said second filter; and said ink being conveyed through said second inhaler, then said ink being transported through said second filter and said second supply pipe, and being ejected via said second print head.

19. A method, comprising:

forming a cartridge having a first surface through which ink is discharged, the ink being discharged from said cartridge to a recordable medium during a printing operation, said cartridge being transported back and forth along a first line of motion;

storing ink in an ink reservoir in said cartridge;

attaching a first print head to said first surface of said cartridge, said first print head comprising a first plurality of nozzles forming at least one row substantially perpendicular to said first line of motion, said at least one row of said first plurality of nozzles forming a substantially straight line, said at least one row of said first plurality of nozzles including a first bottom nozzle in a lowest position of said first print head and a first top nozzle in a highest position of said first print head, all adjacent nozzles in said at least one row of said first plurality of nozzles being separated from each other by an equal distance, said first print head having a first printing height, said first printing height being measured from said first bottom nozzle to said first top nozzle in a direction perpendicular to said first line of motion;

attaching a second print head to said first surface, said second print head comprising a second plurality of nozzles forming at least one row substantially perpendicular to said first line of motion, said at least one row of said second plurality of nozzles forming a substantially straight line, said at least one row of said second plurality of nozzles including a second bottom nozzle in a lowest position of said second print head and a second top nozzle in a highest position of said second print head, all adjacent nozzles in said at least one row of said second plurality of nozzles being separated from each other by said equal distance, said second print head having a second printing height, said second printing height being measured from said second bottom nozzle to said second top nozzle in the direction perpendicular to said first line of motion;

arranging said first print head and said second print head on said first surface with said at least one row of said first plurality of nozzles being substantially parallel to said at least one row of said second plurality of nozzles, said cartridge having a total printing height corresponding to a height from said second bottom nozzle up to said first top nozzle as measured in the direction perpendicular to said first line of motion with said first and second print heads buffing attached to said first surface, said total printing height being substantially equal to the sum of both said first printing height and said second printing height, said first bottom nozzle being separated from said second top nozzle by said equal distance as measured in the direction perpendicular to said first line of motion;

conveying the ink from said reservoir to said first print head through a first supply pipe;

conveying the ink from said reservoir to said second print head through a second supply pipe; and ejecting the ink from said reservoir through said nozzles of said first print head to a recordable medium during the printing operation, and ejecting the ink from said reservoir through said nozzles of said second print head to the recordable medium during the printing operation.

20. The method of claim 19, said first and second supply pipes being separately located.

21. The method of claim 20, further comprising:

filtering contaminants from the ink with a first filter before said ejecting of the ink, said first filter being positioned adjacent to said first supply pipe; and filtering contaminants from the ink with a second filter before said ejecting of the ink, said second filter being positioned adjacent to said second supply pipe, said first and second filters being separately located.

22. The method of claim 20, further comprising separating said first print head from said second print head on said first surface by a predetermined distance between a center of said first print head and a center of said second print head, said predetermined distance being measured in a direction substantially parallel to said first line of motion.

23. The method of claim 19, further comprising:

said first and second supply pipes being separately located;

filtering contaminants from the ink with a first filter before said ejecting of the ink from said first print head, said first filter being positioned adjacent to said first supply pipe;

filtering contaminants from the ink with a second filter before said ejecting of the ink from said second print head, said second filter being positioned adjacent to said second supply pipe, said first and second filters being separately located;

separating said first print head from said second print head on said first surface by a predetermined distance between a center of said first print head and a center of said second print head, said predetermined distance being measured in a direction substantially parallel to said first line of motion;

exchanging gas between an interior of said reservoir and an exterior or of said reservoir, said exchanging being performed by a first vent for the operation of said first print head; and venting gas between an interior of said reservoir and an exterior of said reservoir, said venting being performed by a second vent for the operation of said second print head, said first and second vents being separately located.

* * * * *